US008297913B2

(12) United States Patent
Hanai

(10) Patent No.: US 8,297,913 B2
(45) Date of Patent: Oct. 30, 2012

(54) FUEL PUMP

(75) Inventor: Kazumichi Hanai, Obu (JP)

(73) Assignee: Aisan Kogyo Kabushiki Kaisha, Aichi-ken (JP)

( * ) Notice: Subject to any disclaimer, the term of this patent is extended or adjusted under 35 U.S.C. 154(b) by 1218 days.

(21) Appl. No.: 11/862,258

(22) Filed: Sep. 27, 2007

(65) Prior Publication Data

US 2008/0085181 A1 Apr. 10, 2008

(30) Foreign Application Priority Data

Oct. 6, 2006 (JP) ..... 2006-274735

(51) Int. Cl.
*F04D 5/00* (2006.01)

(52) U.S. Cl. ..... 415/55.1; 415/55.3; 415/106

(58) Field of Classification Search ..... 415/55.1–55.7, 415/104, 106, 224
See application file for complete search history.

(56) References Cited

U.S. PATENT DOCUMENTS

| | | | |
|---|---|---|---|
| 5,137,418 | A | 8/1992 | Sieghartner |
| 6,210,102 | B1 | 4/2001 | Yu et al. |

FOREIGN PATENT DOCUMENTS

| | | | |
|---|---|---|---|
| FR | 2713712 | A1 * | 6/1995 |
| JP | 5827869 | | 2/1983 |
| JP | 6506279 | | 7/1994 |
| JP | 2001153081 | | 6/2001 |
| JP | 2005147033 | | 6/2005 |
| WO | 9211459 | | 7/1992 |

OTHER PUBLICATIONS

Machine Translation of FR2,713,712 from ESPACEnet retrieved on Dec. 27, 2011.*

* cited by examiner

*Primary Examiner* — Igor Kershteyn
*Assistant Examiner* — Jesse Prager
(74) *Attorney, Agent, or Firm* — Dennison, Schultz & MacDonald

(57) ABSTRACT

A fuel pump has a casing and an impeller. The impeller is substantially disk shaped having an upper surface and a lower surface The impeller is rotatable within the casing around a rotational axis. A plurality of impeller depressions is formed in at least the lower surface of the impeller. The plurality of impeller depressions is located on at least one of the inside and the outside of a group of concavities. The plurality of impeller depressions is arranged on a circle around the rotational axis of the impeller. Each of the impeller depressions has its deepest portion in a rear half thereof with respect to the rotational direction of the impeller.

8 Claims, 8 Drawing Sheets

FUEL PUMP

CROSS-REFERENCE TO RELATED APPLICATION

The present application claims priority based on Japanese Patent Application 2006-274735 filed on Oct. 6, 2006, the contents of which are hereby incorporated by reference within this application.

BACKGROUND OF THE INVENTION

1. Field of the Invention

The present invention relates to a fuel pump that intakes fuel, boosts the fuel pressure, and pumps out the fuel with the boosted pressure, and more particularly to a technology for reducing frictional force acting upon an impeller of the fuel pump when the impeller rotates.

2. Description of the Related Art

A typical configuration of the conventional fuel pump will be explained below with reference to FIG. 14.

In a fuel pump 100, a motor unit 200 and a pump unit 300 are accommodated in a common housing 110. The motor unit 200 has a rotor 202. The rotor 202 has a motor shaft 204, a laminated iron core 206 fixed to the motor shaft 204, coils (not shown in the figure) wound on the laminated iron core 206, and a commutator 208 connected to end portions of each of the coils. The motor shaft 204 is supported rotatably with respect to the common housing 110 by a bearing 210 and a bearing 302 of the pump unit 300. A permanent magnet 207 is fixed inside the common housing 110 so as to surround the rotor 202. A terminal (not shown in the figure) is provided at a top cover 120 attached to the upper portion of the common housing 110. The motor unit 200 is supplied with electric power through the terminal. When the commutator 208 is supplied with electric power via a brush 212, the rotor 202 and motor shaft 204 rotate.

The pump unit 300 is accommodated in the lower portion of the common housing 110. The pump unit 300 comprises a substantially disk-shaped impeller 310, an upper casing 320, and a lower casing 330. A group of boost ports 312 is provided at an upper surface of the impeller 310 along a periphery of the impeller 310. A group of boost ports 314 is provided at a lower surface of the impeller 310 along the periphery of the impeller 310. The upper and lower casing 320,330 accommodate the impeller 310. A first boost groove 334 is formed in the lower casing 330 facing the group of boost ports 314. A second boost groove 322 is formed in the upper casing 320 facing the group of boost ports 312. When viewed along a rotational axis of the impeller 310, the first boost groove 334 and the second boost groove 322 are formed to have an almost C-like shape from an upstream end to a downstream end along the rotational direction of the impeller 310. An intake hole 332 is formed so as to be linked to the upstream end of the first boost groove 334. A discharge hole 324 is formed so as to be linked to the downstream end of the second boost groove 322. A first boost path 344 is formed by the group of boost ports 314 provided in the lower surface of the impeller 310 and the first boost groove 334 provided in the lower casing 330. A second boost path 342 is formed by the group of boost ports 312 provided in the upper surface of the impeller 310 and the second boost groove 322 provided in the upper casing 320. A central opening that engages with the motor shaft 204 is provided in the center of the impeller 310, and when the motor shaft 204 rotates, the impeller 310 also rotates.

When the impeller 310 rotates between the upper casing 320 and the lower casing 330, the fuel is sucked in from the intake hole 332 into the pump unit 300 and introduced into the boost paths 342, 344. The fuel whose pressure increases while it flows in the boost paths 342, 344 is pumped out from the fuel discharge hole 324 into the motor unit 200. The fuel that is pumped out into the motor unit 200 passes through the motor unit 200 and is pumped out to the outside from a port 122 formed in the top cover 120.

Part of the fuel under high pressure that is pumped out to the motor unit 200 flows back via a clearance around the motor shaft 204 into a space formed between the upper casing 320 and lower casing 330. This high-pressure fuel acts upon the upper surface of the impeller 310 and pushes the impeller 310 down. As a result, the impeller 310 rotates in a state of being pressed against the lower casing 330. When the impeller 310 rotates in a state in which the impeller 310 is pressed against the lower casing 330 and frictional force acts upon the impeller 310, the revolution speed of the impeller 310 decreases and pump efficiency drops.

Accordingly, the fuel pump described in International Patent Application Laid-open Publication No. WO92/011459 has a plurality of depressions 316 formed on the lower surface of the impeller 310. As shown in FIG. 15, the plurality of depressions 316 is disposed annularly and equidistantly in the circumferential direction on the inside of the group of boost ports 314 of the impeller 310. FIG. 15 is a cross-sectional view obtained when the fuel pump described in International Patent Application Laid-open Publication No. WO92/011459 is cut along the XV-XV line in FIG. 14. The edge of depression 316 on the front side in the impeller rotational direction is formed as a circular arc in the planar view thereof. The edge on the rear side has a linear shape. FIG. 16 is a cross-sectional view taken along the XVI-XVI line in FIG. 15. As shown in FIG. 16, the depression 316 is formed such that the front edge side is deeper than the rear edge side. When the impeller 310 rotates, part of the fuel located between the impeller 310 and the lower casing 330 is introduced into the depression 316, as shown by an arrow in FIG. 16. The fuel introduced into the depression 316 flows along the bottom wall surface of the depression 316 in the direction opposite to the impeller rotational direction. The fuel then flows out from the depression 316 so as to be pushed into the gap between the impeller 310 and the lower casing 330. Therefore, a pressure in the direction of separating the impeller 310 from the lower casing 330 is generated at the rear edge (boundary of the depression 316 and the gap) of the depression 316. As a result, the impeller 310 is prevented from rotating in a state of being pressed against the lower casing 330, and frictional force acting upon the impeller 310 when the impeller rotates is reduced. In the fuel pump disclosed in International Patent Application Laid-open Publication No. WO92/011459, the rear edge of the depression 316 is called a "pinch point" where the pressure is generated.

BRIEF SUMMARY OF THE INVENTION

In the fuel pump disclosed in International Patent Application Laid-open Publication No. WO92/011459, the region where the flow channel inside the depression 316 gradually narrows toward the pinch point at the rear edge is important for generating pressure. Therefore, this region has to be formed with especially high dimensional accuracy. Even in the deepest portion on the front edge side, a depth of the depression 316 is formed from several microns to several tens of microns. Thus, when the depression 316 is formed at such a small depth and in such a way the depth decreases gradually toward the rear edge (the flow channel gradually becomes narrower), the allowable margin of error is narrow and the depression is difficult to form.

The present invention was created to resolve the aforementioned problems. And it is an object thereof to provide a fuel pump in which frictional force between an impeller and a casing can be reduced even if the margin of error for the impeller, etc. is allowed to be larger than the conventional margin of error.

The inventors have studied the relationship between the shape of depressions formed in at least one surface from among the lower surface and upper surface of the impeller and frictional force between the impeller and the casing. As a result, it was found that the depression of a specific shape not having a configuration in which the flow channel narrows gradually toward the pinch point at the rear edge in the impeller rotational direction can reduce the frictional force between the impeller and the casing. Furthermore, it was found that the frictional force can be decreased by forming depressions of a specific shape in at least the inner surface of the casing that faces the lower surface of the impeller. Also, it was found that the frictional force can be reduced by forming through holes of a specific shape in the impeller. It is also confirmed that the allowable margin of error for the impeller or casing becomes larger than the conventional ones by adopting the specific shape of the invention. The technology disclosed in the present specification was created with this information in view.

The fuel pump according to the invention comprises a casing and an impeller. The impeller is substantially disk shaped, and has an upper surface and a lower surface. The impeller rotates within the casing around a rotational axis.

A group of concavities is formed in each of the upper and lower surfaces of the impeller. The group of concavities is arranged on a circle around the rotational axis of the impeller.

A first groove is formed in an inner surface of the casing. The first groove faces the group of concavities formed in the lower surface of the impeller. Further, the first groove extends from an upstream end to a downstream end along a rotational direction of the impeller.

A second groove is formed in the inner surface of the casing The second groove faces the group of concavities formed in the upper surface of the impeller. Further, the second groove extends from an upstream end to a downstream end along the impeller rotational direction.

A fuel intake hole is formed in the casing. The fuel intake hole passes through the casing from the exterior of the casing to the upstream end of the first groove.

A fuel discharge hole is formed in the casing. The fuel discharge hole passes through the casing from the downstream end of the second groove to the exterior of the casing.

A plurality of impeller depressions is formed in at least the lower surface of the impeller. The plurality of impeller depressions is located on at least one of the inside and the outside of the group of concavities. Further, the plurality of impeller depressions is arranged on a circle around the rotational axis of the impeller. Each of the impeller depressions has its deepest portion in a rear half thereof with respect to the impeller rotational direction. The group of concavities is generally called a group of boost ports for fuel.

The plurality of impeller depressions may be formed in at least the lower surface of the impeller, or may be formed in both the upper surface and the lower surface of the impeller.

The impeller depressions are preferably disposed with a predetermined spacing therebetween in the circumferential direction, but the spacing is not necessarily constant. The plurality of impeller depressions may be disposed along the outer circumference of the impeller or may either be arranged along or not along the group of concavities.

When the impeller connected to the motor shaft is rotary driven, the fuel introduced into each of the impeller depressions flows in the direction opposite to the impeller rotational direction. In each of the impeller depressions, the fuel flows from the front edge toward the rear edge in the rotational direction of the impeller. In each of the impeller depressions in accordance with the present invention, the deepest portion is formed in the rear half of the impeller depression in the impeller rotational direction. As a result, the fuel introduced into each of the impeller depressions will flow from the deepest portion of the impeller depression toward the casing. As a result, a pressure will be generated in the direction of separating the impeller from the casing. By this pressure, the impeller will be prevented from rotating in a state of being pressed against the casing, and frictional force acting upon the impeller when the impeller is rotated is reduced.

Further, a region from the deepest portion formed in a position in the rear half in the impeller rotational direction toward the rear edge is a region where the aforementioned pressure is generated. The figure of this region is only required to initiate a flow of fuel from the deepest portion toward the casing. The figure of this region is not required to be formed with any especially high dimensional accuracy and an allowable margin of error becomes large. Accordingly, the cost of forming the impeller depressions can be reduced. As a result, the production cost of the fuel pump can be reduced.

The present invention also realizes another fuel pump. The alternative fuel pump does not have the impeller depressions. Instead, the alternative fuel pump has a plurality of casing depressions. The plurality of casing depressions is formed in at least the inner surface of the casing that faces the lower surface of the impeller. The plurality of casing depressions is located on at least one of the inside and the outside of the group of concavities formed in the lower surface of the impeller. Further, the plurality of casing depressions is arranged on a circle around the rotational axis of the impeller. Each of the casing depressions has its deepest portion in a front half thereof with respect to the rotational direction of the impeller.

When the impeller connected to the motor shaft is rotary driven, the fuel introduced into each of the casing depressions flows in the same direction as the impeller rotational direction. In each of the casing depressions, the fuel flows from the rear edge toward the front edge in the rotational direction of the impeller. In each of the casing depressions in accordance with the present invention, the deepest portion is formed in the front half of the casing depression in the impeller rotational direction. As a result, the fuel introduced into each of the casing depressions flows from the deepest portion of the casing depression toward the impeller. As a result, a pressure will be generated in the direction of separating the impeller from the casing By this pressure, the impeller is prevented from rotating in a state of being pressed against the casing, and frictional force acting upon the impeller when the impeller rotates is reduced.

Further, a region from the deepest portion formed in the front half in the impeller rotational direction toward the front edge is a region where the aforementioned pressure is generated. The figure of this region is only required to initiate a flow of fuel from the deepest portion toward the impeller. The figure of this region is not required to be formed with any especially high dimensional accuracy and an allowable margin of error becomes large. Accordingly, the cost of forming the casing depressions can be reduced. As a result, the production cost of the fuel pump can be reduced.

The present invention also realizes a further another following fuel pump. The fuel pump of this aspect does not have the impeller depressions and the casing depressions. Instead, the fuel pump of this aspect has a plurality of through holes passing through the impeller from the upper surface to the lower surface thereof. The plurality of through holes is located on at least one of the inside and the outside of the group of concavities formed in the impeller. Further, the plurality of through holes is arranged on a circle around the rotational axis of the impeller. Further, an opening of each of the through holes in the upper surface of the impeller is larger than an opening of each of the through holes in the lower surface of the impeller. Furthermore, at least an inner wall surface on the front side of each of the through holes is inclined forward from the lower surface of the impeller toward the upper surface of the impeller along the rotational direction of the impeller.

When the impeller connected to the motor shaft is rotary driven, the fuel introduced into each of the through holes flows toward the casing that faces the lower surface of the impeller. The fuel introduced into each of the through holes is pushed toward the small opening formed in the lower surface of the impeller. The fuel is pushed out from the small opening of the impeller toward the inner surface of casing that faces the lower surface of the impeller. As a result, a pressure is generated in the direction of separating the lower surface of the impeller from the casing. By this pressure, the impeller is prevented from rotating in a state of being pressed against the casing, and frictional force acting upon the impeller when the impeller rotates is reduced.

The present invention also realizes a following fuel pump. The fuel pump of this aspect has a plurality of combined holes passing through the impeller from the upper surface to the lower surface thereof. Each of the combined holes has a through hole formed in the impeller and an impeller depression formed on the lower surface of the impeller. The plurality of combined holes is located on at least one of the inside and the outside of the group of concavities formed in the impeller. The plurality of combined holes is arranged on a circle around the rotational axis of the impeller. Further, an inner wall surface on the rear side of each of the combined holes is almost perpendicular to the upper surface and lower surface of the impeller or inclined forward from the lower surface of the impeller toward the upper surface of the impeller in the rotational direction of the impeller. An inner wall surface on the front side of each of the combined holes has a projecting part that projects toward the inner wall surface on the rear side.

In the above-described fuel pump, part of the fuel located between the upper surface of the impeller and the inner surface of the casing flows from the upper surface side of the impeller to the lower surface side of the impeller via the combined holes in the direction opposite to the impeller rotational direction. Further, part of the fuel located between the lower surface of the impeller and the inner surface of the casing is introduced into a portion of each of the combined holes where the channel widened at the lower surface side of the impeller, and the fuel flows along the inner wall surface in the direction opposite to the impeller rotational direction. The flows of fuel from the upper surface side and the lower surface side merge and advance together toward the casing that faces the lower surface of the impeller. As a result, a large pressure is generated in the direction of separating the lower surface of the impeller from the casing. By this pressure, the impeller is prevented from rotating in a state of being pressed against the casing, and frictional force acting upon the impeller when the impeller rotates is reduced.

DETAILED DESCRIPTION OF THE INVENTION

The preferred features of the present invention will be described below.

(First preferred feature) Pressure generating means is provided in the fuel pump that causes a fuel located between an impeller and a casing to flow in a direction of generating pressure for separating the impeller from the casing.

(Second preferred feature) The opening width of an impeller depression decreases toward the edge on the rear side in the impeller rotational direction.

(Third preferred feature) The opening width of a casing depression decreases toward the edge on the front side in the impeller rotational direction.

(First Embodiment)

Figure 1:
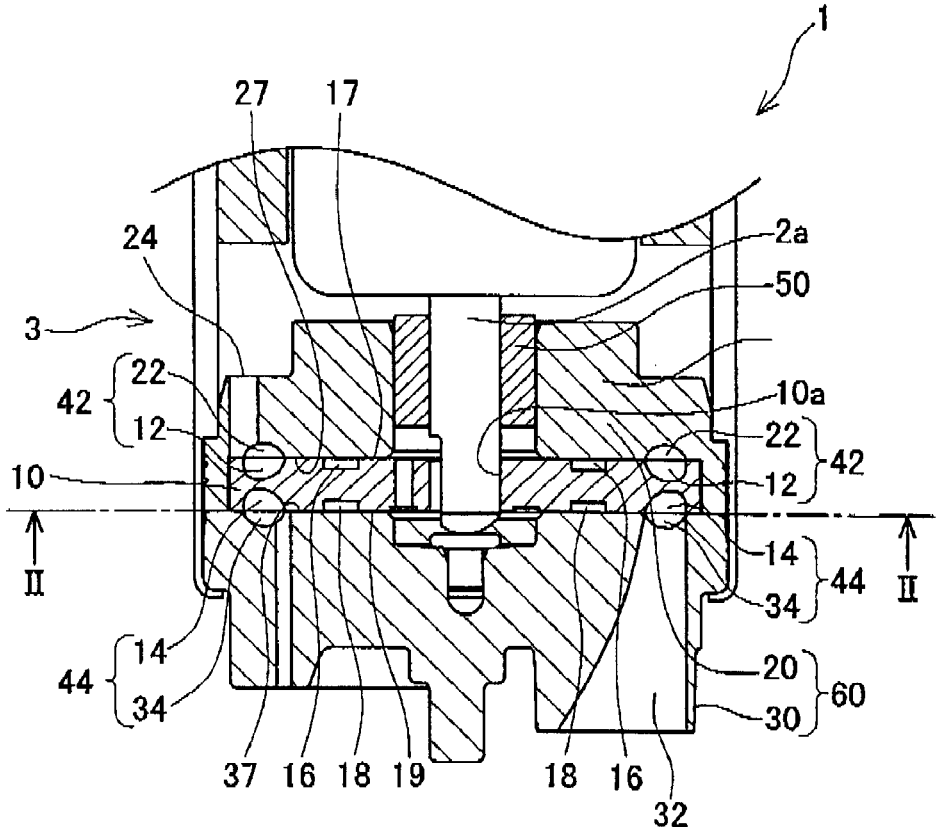
FIG. 1 schematically shows a cross-sectional view of the pump unit of the fuel pump of the first embodiment.

A first embodiment of the fuel pump of the present invention will be described below with reference to FIG. 1 to FIG. 3. FIG. 1 schematically shows a cross-sectional view of a pump unit of the fuel pump of the present embodiment.

In a fuel pump 1 such as shown in FIG. 1, a motor unit and a pump unit 3 are accommodated in a common housing.

Because the motor unit and the common housing are similar to that of the conventional fuel pump, explanation thereof is herein omitted. The pump unit 3 comprises an impeller 10 and a casing 60 (an upper casing 20 and a lower casing 30).

The impeller 10 is substantially disk shaped and comprises a central opening 10*a* in the center thereof for receiving a motor shaft 2*a* so that the motor shaft 2*a* cannot rotate relative to the impeller 10. When the motor shaft 2*a* rotates, the impeller 10 also rotates in the casing 60. In the vicinity of outer circumference of an impeller upper surface 17, boost ports 12 (concavities) are formed repeatedly along the outer circumference. In the vicinity of outer circumference of an impeller lower surface 19, boost ports 14 are formed repeatedly along the outer circumference.

In a surface 37 (referred to hereinbelow as "first surface 37") of the lower casing 30 that faces the impeller lower surface 19, a first boost groove 34 is formed facing a plurality of boost ports 14 formed in the lower surface 19 of the impeller 10. In a surface 27 (referred to hereinbelow as "second surface 27") of the upper casing 20 that faces the impeller upper surface 17, a second boost groove 22 is formed facing a plurality of boost ports 12 formed in the upper surface 17 of the impeller 10. In a plan view of the first and second surfaces 27, 37, the first boost groove 34 and the second boost groove 22 are formed to have an almost C-like shape from an upstream end to a downstream end along the rotational direction of the impeller 10. A first boost path 44 is formed by a plurality of boost ports 14 provided in the lower surface 19 of the impeller 10 and the first boost groove 34 formed in the lower casing 30. A second boost path 42 is formed by a plurality of boost ports 12 provided in the upper surface 17 of the impeller 10 and the second boost groove 22 formed in the upper casing 20. A fuel intake hole 32 connected to the first boost groove 34 is formed at the upstream end of the first boost groove 34. A fuel discharge hole 24 connected to the second boost groove 22 is formed at the downstream end of the second boost groove 22.

When the motor is driven, the impeller 10 rotates between the upper casing 20 and the lower casing 30, the fuel is sucked in from the fuel intake hole 32 into the pump unit 3 and introduced into the first boost path 44 and the second boost path 42. The fuel whose pressure increases while it flows in the first boost path 44 and the second boost path 42 is pumped out from the fuel discharge hole 24 into the motor unit. The fuel that is pumped out into the motor unit passes through the motor unit and is pumped out to the outside from a port (not shown in the figure) formed in the upper part of the fuel pump 1.

A plurality of depressions 18 for reducing the frictional force acting upon the impeller 10 when it rotates is formed in the lower surface 19 of the impeller 10. The plurality of depressions 18 is formed on the inside of the plurality of boost ports 14. A plurality of depressions 16 for reducing the frictional force acting upon the impeller 10 when it rotates is formed in the upper surface 17 of the impeller 10. The plurality of depressions 16 is formed on the inside of the plurality of boost ports 12. The shape of depressions 16, 18 is described below.

Figure 2:
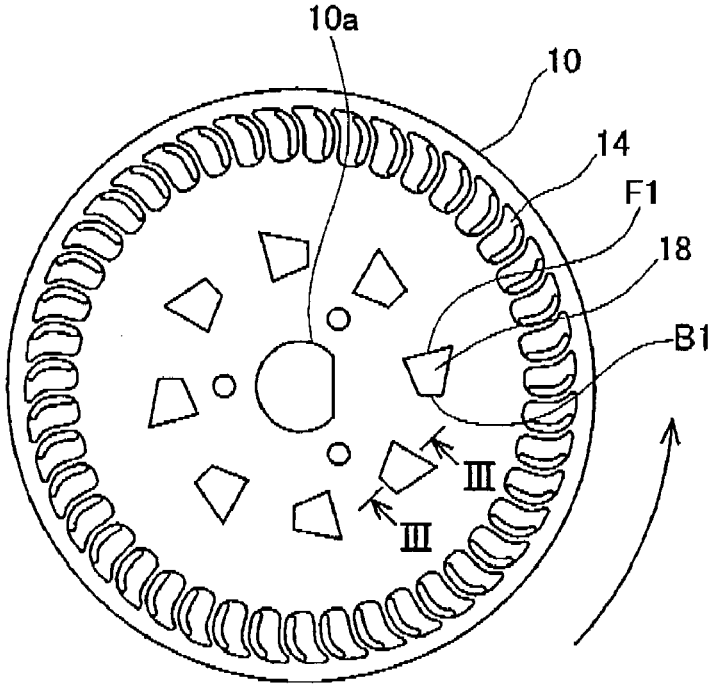
FIG. 2 schematically shows a plan view of the impeller of the first embodiment that is a cross-sectional view taken along the II-II line in FIG. 1.

FIG. 2 is a plan view of the impeller 10 obtained when the impeller 10 is viewed from below as shown in FIG. 1. Eight depressions 18 are formed equidistantly in the circumferential direction in the lower surface 19 of the impeller 10. Each of the depressions 18 is formed to have an almost trapezoidal shape in the plan view thereof. Each of the depressions is formed such that the width of an edge at the rear side of the depression (length of the trapezoid on the rear side) in the impeller rotational direction (direction shown by an arrow in FIG. 2) is less than the width on the front side (length of the trapezoid on the front side). Eight depressions 16 (not shown in the figure) are also formed in the upper surface 17 of the impeller 10, similarly to the depressions 18 in the lower surface 19 shown in FIG. 2. Similarly to the depressions 18, each of the depressions 16 in the upper surface 17 of the impeller 10 is formed to have an almost trapezoidal shape in the plan view thereof. Each of the depressions is formed such that the width thereof at the rear side in the impeller rotational direction is less than the width of the edge at the front side.

Figure 3:
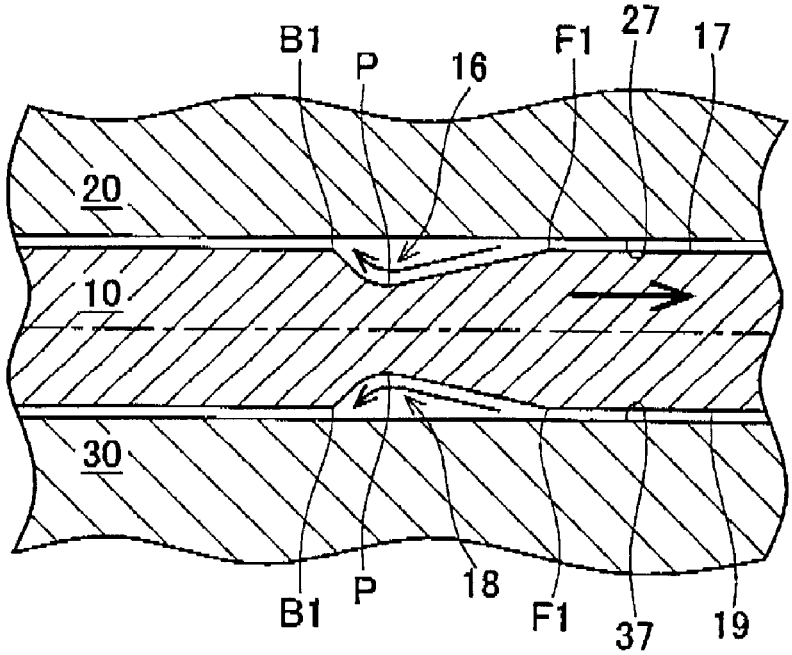
FIG. 3 schematically shows a cross-sectional view of the depressions provided in the impeller that is a cross-sectional view taken along the III-III line in FIG. 2.

FIG. 3 is a cross-sectional view taken along the III-III line in FIG. 2. The depressions 16, 18 have the deepest portion P closer to the rear side edge (left side in FIG. 3) in the impeller rotational direction. A bottom surface from a front edge F1 to the deepest portion P and a bottom surface from the deepest portion P to the rear edge B1 are formed as smooth surfaces. The inclination of the bottom surface from the front edge F1 to the deepest portion P is more gradual than that of the bottom surface from the deepest portion P to the rear edge B1. Each of the depressions 16, 18 is formed such that the cross section area thereof decreases from the deepest portion P toward the rear edge B1. Both the width and depth of each of the depressions 16, 18 decrease from the deepest portion P toward the rear edge B1.

In a region between the upper surface 17 of the impeller 10 and the upper casing 20 wherein the second boost path 42 is not formed, and in a region between the lower surface 19 of the impeller 10 and the lower casing 30 wherein the first boost path 44 is not formed, the fuel is carried along by the impeller 10 rotating at a high rate, due to its own viscosity, at a certain rate (according to the level of viscosity thereof) in the impeller rotational direction. However, the rotation rate of the impeller 10 is obviously higher than the rotation rate of the fuel being pulled by the impeller 10. Therefore, part of the fuel rotating with the rotation rate lower than that of the impeller 10 is introduced, as shown in FIG. 3, into the depressions 16 in the upper surface 17 of the impeller 10 and the depressions 18 in the lower surface 19 of the impeller 10 and flows inside the depressions 16, 18 along the bottom wall surface of the depressions 16, 18 in the direction opposite to the impeller rotational direction (counter-flows). The depressions 16, 18 are formed such that the deepest portions P are formed in the rear half of the depressions 16, 18 with respect to the impeller rotational direction. Therefore, the fuel introduced into the depression 18 flows from the deepest portion P of the depression 18 toward the first surface 37 of the lower casing 30. As a result, a pressure is generated in the direction of separating the impeller 10 from the lower casing 30. Further, the fuel introduced into the depression 16 flows from the deepest portion P of the depression 16 toward the second surface 27 of the upper casing 20. As a result, a pressure is generated in the direction of separating the impeller 10 from the upper casing 20. The impeller 10 is located at a height where the two pressures are balanced. The impeller 10 is rotated in a state of being separated from the upper casing 20 and the lower casing 30. As a result, the impeller 10 is prevented from rotating in a state of being pressed against the upper casing 20 or the lower casing 30, and frictional force acting upon the impeller 10 when the impeller is rotates is reduced.

In the depressions 16, 18, a region from the deepest portion P to the rear edge B1 in the impeller rotational direction is a region where the aforementioned pressure is generated. In the depressions 16, 18 of the fuel pump 1 of the present embodiment, the figure of this region is required to initiate a flow of fuel from the deepest portion P toward the casing, so this region is not required to be formed with any particular high degree of dimensional accuracy and an allowable margin of error becomes large. Accordingly, the cost of forming the depressions 16, 18 can be reduced. As a result, the production cost of the fuel pump 1 can be reduced.

In the depressions 16, 18, the width of the front edge F1 in the impeller rotational direction widens, thereby facilitating the introduction of fuel into the depressions 16, 18. Further, the width of the rear edge B1 narrows and the cross-sectional area thereof decreases from the deepest portion P toward the rear edge B1. Therefore, the fuel introduced into the depressions 16, 18 is pushed into the narrowing channel and flows under a comparatively strong force from the deepest portion P toward the casings. As a result, a comparatively large pressure can be generated in the direction of separating the impeller 10 from the casings.

Further, the depressions 16, 18 are formed on the inner circumferential side of the boost ports 12, 14 that are formed close to the outer periphery. The region on the inside of the boost ports 12, 14 is wider than the region on the outside. Therefore, the depressions 16, 18 can be easily formed.

Further, pluralities of depressions 16, 18 are formed equidistantly in the circumferential direction in the impeller 10. The pressures generated by each of the depressions 16 are added up to obtain a resultant pressure corresponding to the number of depressions 16 (eight in the present embodiment). The pressures generated by the depressions 18 are added up to obtain a resultant pressure corresponding to the number of depressions 18 (eight in the present embodiment). Therefore, a comparatively large pressure is generated in the direction of separating the impeller 10 from the upper casing 20 and the lower casing 30.

In the present embodiment, a case is explained in which depressions 16 are formed in the upper surface 17 of the impeller 10, and depressions 18 are also formed in the lower surface 19 of the impeller 10, but it is also possible to form only the depressions 18 in the lower surface 19. Generally, part of the fuel under high pressure that is pumped out to the motor unit of the fuel pump is refluxed into the space between the upper casing 20 and the lower casing 30 via the clearance around the motor shaft. This high-pressure fluid acts upon the upper surface 17 of the impeller 10 and pushes the impeller 10 down. As a result, the impeller 10 can be easily caused to rotate in a state of being pressed against the lower casing 30. To prevent such a state, it is sometimes sufficient to form the depressions 18 only in the lower surface 19 of the impeller 10. In this case, the number of depressions can be decreased and cost of the depression formation process can be reduced.

The depressions 16, 18 may also not be disposed along the circumferential direction of the impeller 10 (that is, in the direction along the boost ports 12, 14).

Further, in the embodiment described hereinabove, the depressions 16, 18 have a trapezoidal shape in a planar view thereof, but the shapes of the depressions 16, 18 are not limited, and the depressions may have any shape. The depressions 16, 18 may be of a shape in which the width of the rear edge B1 in the impeller rotational direction is less than the width of the front edge F1. For example, the edge on the rear side in the impeller rotational direction may have an arched shape, and the edge on the front side may have a linear shape.

(Second Embodiment)

Figure 4:
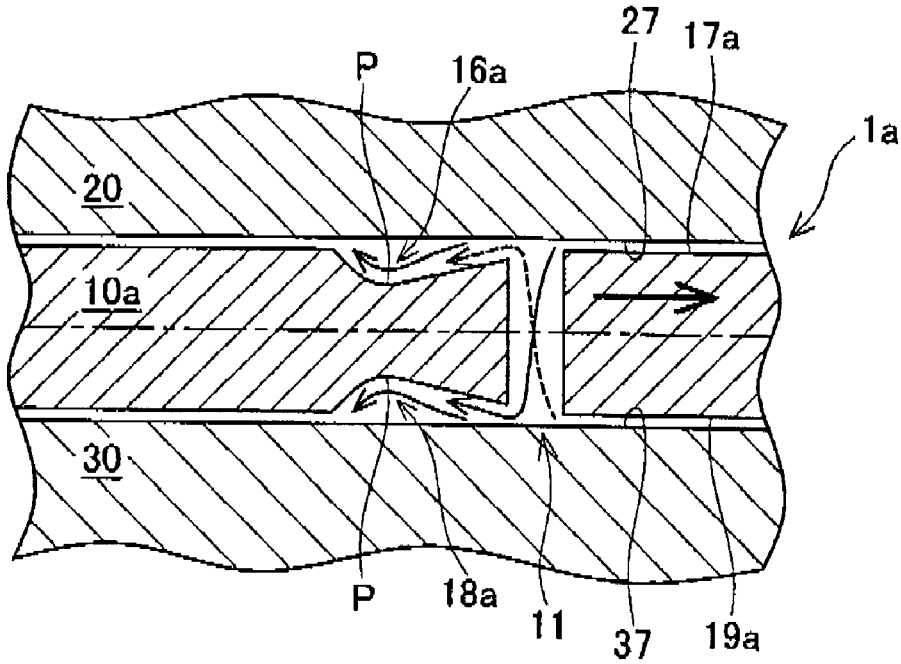
FIG. 4 schematically shows a cross-sectional view of the depressions and the connection hole provided in the impeller of the fuel pump of the second embodiment.

The second embodiment of the fuel pump of the present invention will be described below. The components that differ from those of the fuel pump 1 of the first embodiment will be mainly explained. FIG. 4 schematically shows a cross sectional view of depressions and a connection hole provided in the impeller. A plurality of depressions 16*a* is formed in an upper surface 17*a* of an impeller 10*a* of a fuel pump 1*a*, in the same manner as in the impeller 10 of the first embodiment (see also FIG. 2). Further, a plurality of depressions 18*a* is formed in a lower surface 19*a* of the impeller 10*a*. The depression 16*a* and depression 18*a* are formed in identical positions in the circumferential direction of the upper surface 17*a* and lower surface 19*a*. Each of the depressions 16*a* and corresponding one of depressions 18*a* are connected by a connection hole 11 at the front side of the depressions 16*a*, 18*a* in the impeller rotational direction.

As shown in FIG. 4, part of the fuel located between the upper surface 17*a* of the impeller 10*a* and the upper casing 20 is introduced into the depression 16*a* of the impeller upper surface 17*a*. The fuel introduced into the depression 16*a* flows along the bottom wall surface of the depression 16*a* in the direction opposite to the impeller rotational direction (counter-flow).

Further, part of the fuel located between the lower surface 19*a* of the impeller 10*a* and the lower casing 30 is introduced into the depression 18*a* of the impeller lower surface 19*a*. The fuel introduced into the depression 18*a* flows along the bottom wall surface of the depression 18*a* in the direction opposite to the impeller rotational direction (counter-flows).

Further, when a gap between the upper surface 17*a* of the impeller 10*a* and the upper casing 20 is wider than a gap between the lower surface 19*a* of the impeller 10*a* and the lower casing 30, part of the fuel located between the upper surface 17*a* of the impeller 10*a* and the upper casing 20 is introduced into the depression 18*a* through the connection hole 11 (solid line arrow shown in FIG. 4). The flows of fuel that are thus introduced merge in the depression 18*a*. In most cases the impeller 10*a* receives pressure from above that originates from the fuel with boosted pressure, and therefore in most cases the gap between the upper surface 17*a* of the impeller 10*a* and the upper casing 20 is wider.

When the gap between the lower surface 19*a* of the impeller 10*a* and the lower casing 30 is wider than the gap between the upper surface 17*a* of the impeller 10*a* and the upper casing 20, part of the fuel located between the lower surface 19*a* of the impeller 10*a* and the lower casing 30 is introduced into the depression 16*a* through the connection hole 11 (dotted line arrow shown in FIG. 4). Thus the flows of fuel that are introduced merge in the depression 16*a*.

In the depressions 16*a*, 18*a*, the deepest portion P is formed in the rear half thereof with respect to the impeller rotational direction. Therefore, the fuel introduced into the depression 16*a* flows from the deepest portion P of the depression 16*a* toward a second surface 27 of the upper casing 20. As a result, pressure is generated in the direction of separating the impeller 10*a* from the upper casing 20. Further, the fuel introduced into the depression 18*a* flows from the deepest portion P of the depression 18*a* toward a first surface 37 of the lower casing 30. As a result, pressure is generated in the direction of separating the impeller 10*a* from the lower casing 30. The height of the impeller 10*a* is adjusted to the height where the two pressures are balanced, and the impeller 10*a* is rotated in a state of being separated from the upper casing 20 and the lower casing 30. As a result, the impeller 10*a* is prevented from rotating in a state of being pressed against the upper casing 20 or the lower casing 30, and frictional force acting upon the impeller 10*a* when the impeller rotates is reduced.

In the present embodiment, for example, where depressions 18*a* are formed in the impeller lower surface 19*a*, the fuel on the side of the upper surface 17*a* of the impeller 10*a* is also introduced into the depressions 18*a* via the connection holes 11. Therefore, the amount of fuel introduced into the depressions 18*a* is increased and a comparatively large pressure can be generated in the direction of separating the impeller 10*a* from the lower casing 30.

In the present embodiment, a case is explained in which depressions 16*a* are formed in the upper surface 17*a* of the impeller 10*a*, and depressions 18*a* are also formed in the lower surface 19*a* of the impeller 10*a*, but it is also possible to form only the depressions 18*a* in the lower surface 19*a*.

(Third Embodiment)

The third embodiment of the fuel pump of the present invention will be described below. The components that differ from those of the fuel pump 1 of the first embodiment will be mainly explained. The fuel pump of the third embodiment has through holes of an almost wedge-like cross section that pass through the upper and lower surfaces of the impeller on the inside of the group of boost ports formed in the impeller.

Figure 5:
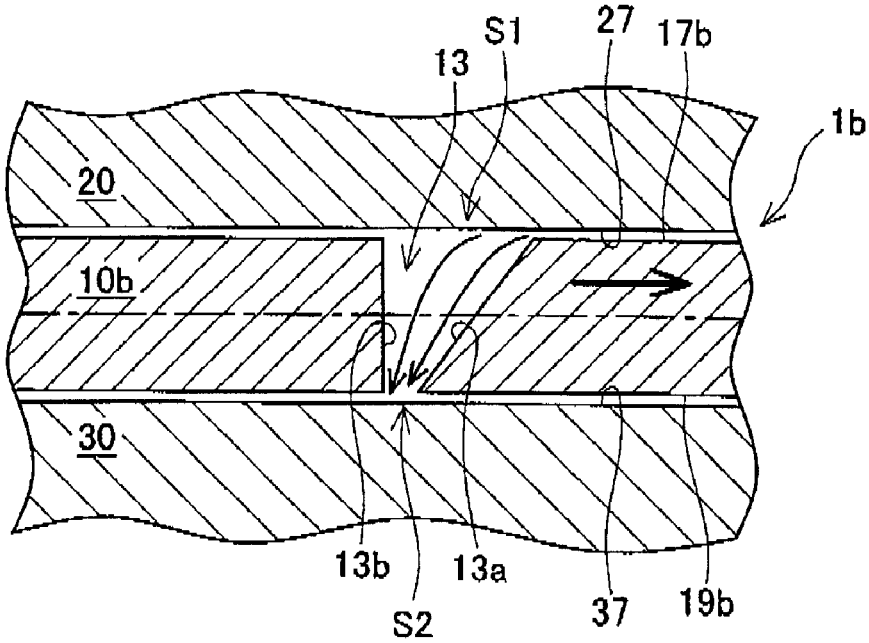
FIG. 5 schematically shows a cross-sectional view of the through hole in the impeller of the fuel pump of the third embodiment.

FIG. 5 is a cross-sectional view of a through hole 13 provided in the impeller. A plurality of through holes 13 is formed repeatedly with a spacing in the circumferential direction in an impeller 10*b* of a fuel pump 1*b*. In the through hole 13, an opening S1 formed in an upper surface 17*b* is larger than an opening S2 formed in a lower surface 19*b*. An inner wall surface 13*b* on the rear side in the impeller rotational direction (arrow direction shown in FIG. 5) is perpendicular to the upper surface 17*b* of the impeller 10*b* and also perpendicular to the lower surface 19*b* of the impeller 10*b*. Further, an inner wall surface 13*a* on the front side is inclined forward from the lower surface 19*b* of the impeller 10*b* toward the upper surface 17*b* of the impeller 10*b* along the impeller rotational direction.

In the fuel pump, part of the fuel located between the upper surface 17*b* of the impeller 10*b* and the upper casing 20 is introduced from the larger opening S1 formed in the upper surface 17*b* of the impeller 10*b* into the through hole 13. The fuel introduced into the through hole 13 flows, while being pushed into a narrowing channel toward the smaller opening S2 in the lower surface 19*b* of the impeller 10*b*. The pushed fuel is further pushed, and flows toward the first surface 37 of the lower casing 30 via the smaller opening S2. Therefore, a pressure is generated in the direction of separating the lower surface 19*b* of the impeller 10*b* from the lower casing 30. As a result, the impeller 10*b* is prevented from rotating in a state of being pressed against the lower casing 30.

In the present embodiment, a case is explained in which the inner wall surface 13*b* on the rear side is perpendicular to the impeller upper surface 17*b* and lower surface 19*b*, but the present invention is not limited to this configuration. For example, the inner wall surface 13*b* on the rear side may be inclined forward from the lower surface 19*b* of the impeller 10*b* toward the upper surface 17*b* of the impeller 10*b* along the impeller rotational direction. At this case, an inclination angle of the inner wall surface 13*a* on the front side with respect to the lower surface 19*b* of the impeller 10*b* should be smaller than an inclination angle of the inner wall surface 13*b* on the rear side with respect to the lower surface 19*b* of the impeller 10*b* so that an opening of the through hole 13 formed in the upper surface 17*b* is larger than an opening formed in the lower surface 19*b*. A pressure is generated in the direction of separating the lower surface 19*b* of the impeller 10*b* from the lower casing 30.

Figure 6:
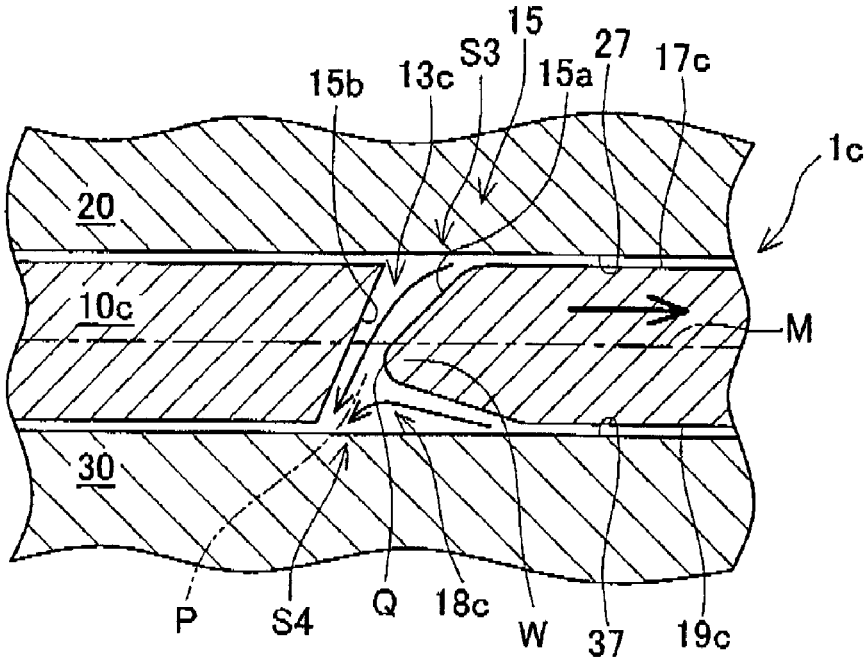
FIG. 6 schematically shows a cross-sectional view of a combined hole in the impeller of the fuel pump of a modification example of the third embodiment.

Further, as in an impeller 10*c* shown in FIG. 6, combined holes 15 may be adopted. Each of the combined holes 15 is formed by a through hole 13*c* and a depression 18*c* formed on a lower surface 19*c* of the impeller 10*c*. In the combined hole 15, a deepest portion P of the depression 18*c* is connected to the through hole 13*c*. Viewing the cross section of the impeller 10*c*, the inner wall surface 15*a* on the front side of the combined hole 15 has a projecting part (convex portion W) that projects toward the inner wall surface 15*b* on the rear side. The inner wall surface 15*b* on the rear side of the combined hole 15 is formed flat from the upper surface 17*c* of the impeller 10*c* toward the lower surface 19*c*. The inner wall surface 15*b* on the rear side of the combined hole 15 is inclined so as to recede from the front side toward the rear side in the impeller rotational direction as it approaches to the lower surface 19*c* of the impeller 10*c*.

In such the fuel pump 1*c*, part of the fuel located between the upper surface 17*c* of the impeller 10*c* and the upper casing 20 is introduced into the combined hole 15 from an opening S3 formed in the upper surface 17*c* of the impeller 10*c*. The fuel introduced into the combined hole 15 flows toward an opening S4 in the lower surface 19*c* of the impeller 10*c* (toward the lower casing 30), while being pushed into the channel that is narrowed in the intermediate portion thereof. Part of the fuel located between the lower surface 19*c* of the impeller 10*c* and the lower casing 30 is introduced into a depression 18*c* formed in the lower surface 19*c* of the impeller 10*c*. This fuel flows inside the depression 18*c* along the bottom wall surface of the depression 18*c* in the direction opposite to the impeller rotational direction (counter-flows). The fuel introduced into the depression 18*c* does not flow via the through hole 13*c* from the apex point Q of the convex portion W (portion where the combined hole 15 is the narrowest) toward the upper surface 17*c* of the impeller 10*c*. This is because the flow from the upper surface 17*c* of the impeller 10*c* toward the opening S4 on the lower surface 19*c* of the impeller 10*c* is stronger than the flow from the lower surface 19*c* of the impeller 10*c* toward the opening S3 on the upper surface 17*c*. The flow of fuel in the combined hole 15 from the opening S3 toward the opening S4 and the flow of fuel in the depression 18*c* merge, and pressure is generated at the opening S4 in the direction of separating the impeller 10*c* from the lower casing 30. This pressure prevents the impeller 10*c* from rotating in a state of being pressed against the lower casing 30, and when the impeller 10*c* rotates, frictional force acting thereupon is reduced.

Figure 7:
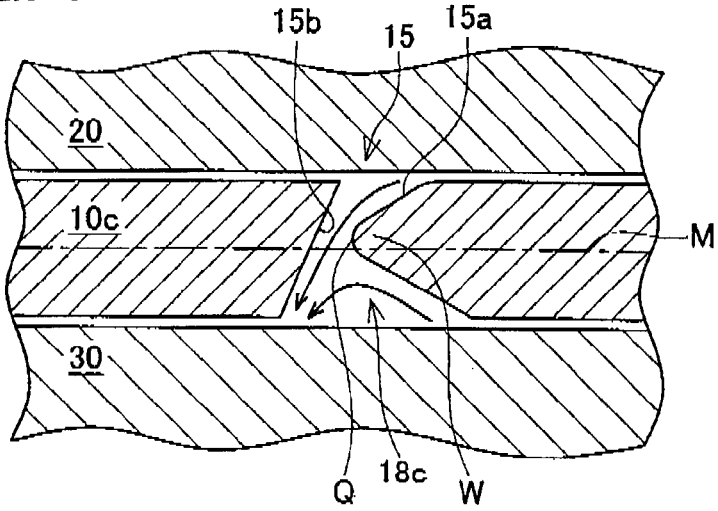
FIG. 7 schematically shows a cross-sectional view of the combined hole in the impeller of the fuel pump of a modification example of the third embodiment.

In the present embodiment of the fuel pump 1*c*, the apex point Q of the convex portion W is disposed below a central line M (shown by a dot-dash line in FIG. 6) in the thickness direction of the impeller 10*c*. However, as in an impeller 10*c* shown in FIG. 7, the present invention also includes a configuration in which the apex point Q of the convex portion W is disposed above the central line M. And the present invention also includes a configuration in which the apex point Q of the convex portion W is disposed on the central line M.

Figure 8:
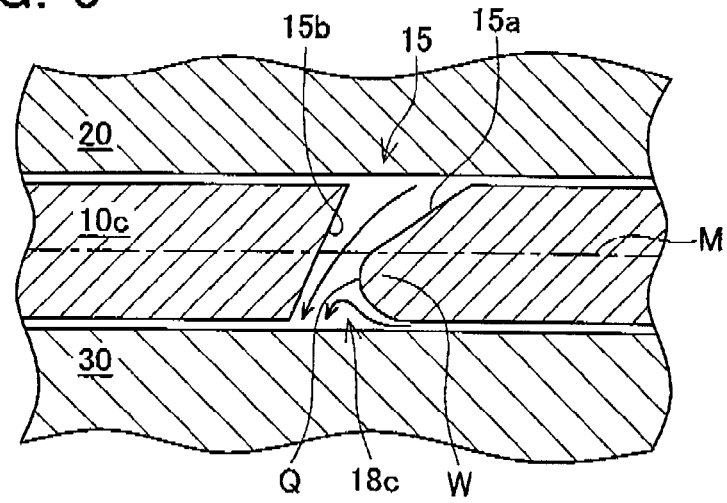
FIG. 8 schematically shows a cross-sectional view of the combined hole in the impeller of the fuel pump of a modification example of the third embodiment.

In the present embodiment of the fuel pump 1*c*, the inner wall surface 15*a* on the front side that is positioned on the lower surface 19*c* side of the convex portion W is inclined gentler than the inner wall surface 15*a* that is positioned on the upper surface 17*c* side of the convex portion W. However, as in an impeller 10*c* shown in FIG. 8, the present invention also includes a configuration in which the inner wall surface 15*a* on the front side that is positioned on the upper surface 17*c* side of the convex portion W is inclined gentler than the inner wall surface 15*a* that is positioned on the lower surface 19*c* side of the convex portion W.

Figure 9:
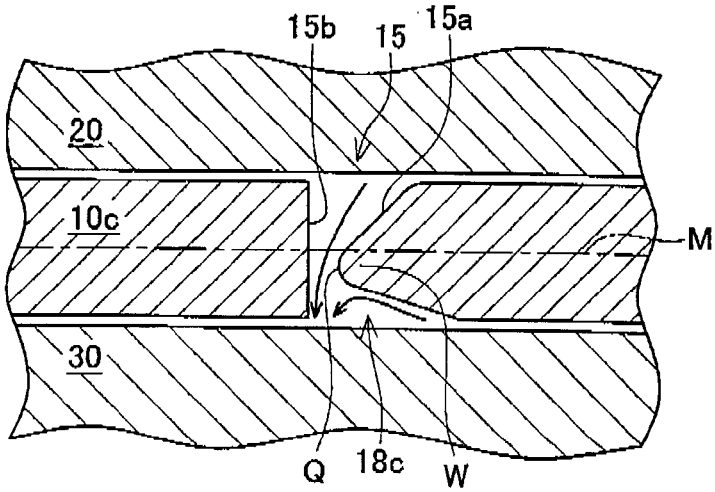
FIG. 9 schematically shows a cross-sectional view of the combined hole in the impeller of the fuel pump of a modification example of the third embodiment.

Further, in the present embodiment, an example is explained in which the inner wall surface 15*b* on the rear side is inclined forward from the lower surface 19*c* of the impeller 10*c* toward the upper surface 17*c* of the impeller 10*c* along the impeller rotational direction, but as in an impeller 10*c* shown in FIG. 9, the inner wall surface 15*b* on the rear side may be perpendicular to the upper surface 17*c* and the lower surface 19*c* of the impeller.

(Fourth Embodiment)

The fourth embodiment of the fuel pump of the present invention will be described below. The components that differ from those of the fuel pump 1 of the first embodiment will be mainly explained. In the fuel pump of the fourth embodiment, a plurality of depressions is provided in the inner surface of the casing that faces the impeller.

Figure 10:
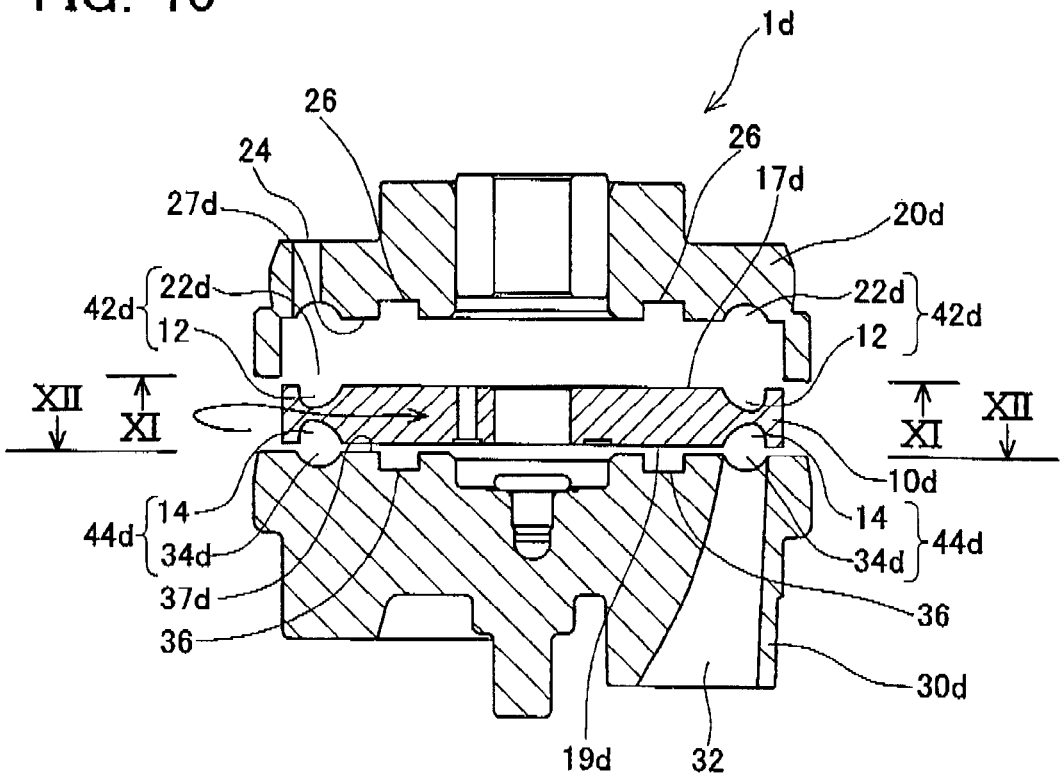
FIG. 10 schematically shows a cross-sectional view of the pump unit of the fuel pump of the fourth embodiment.

FIG. 10 schematically shows a cross-sectional view of a pump unit of the fuel pump of the present embodiment. As shown in FIG. 10, a pump unit of a fuel pump 1*d* comprises an impeller 10*d*, an upper casing 20*d*, a lower casing 30*d*, and a motor shaft. In FIG. 10, parts are shown at a disassembled position.

In the impeller 10*d* that is different from the impeller 10 of the first embodiment, depressions for reducing frictional force acting upon the impeller when the impeller rotates are not provided. Other features of the impeller 10*d* are identical to those of the impeller 10 and explanation thereof is herein omitted.

Figure 11:
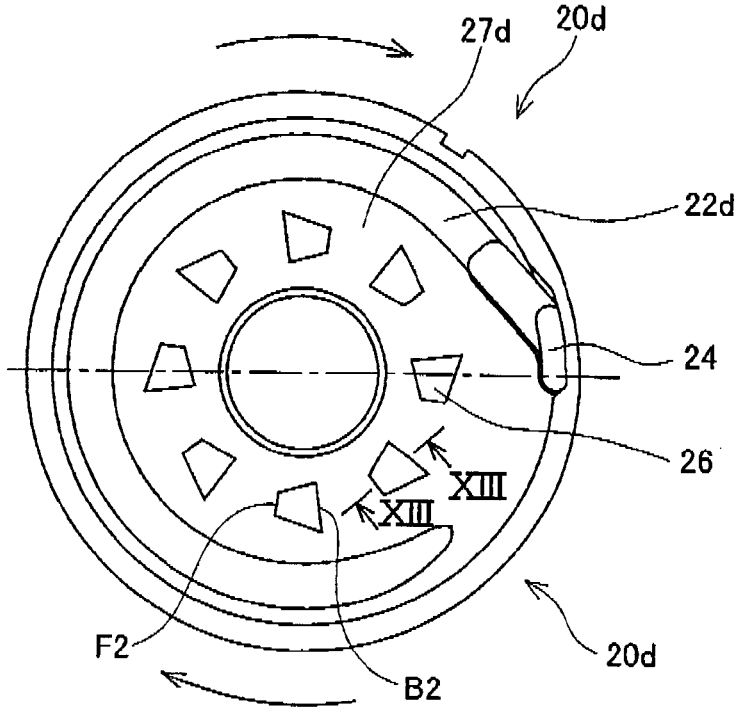
FIG. 11 schematically shows a plan view of the upper casing that is a cross-sectional view taken along the XI-XI line in FIG. 10.
Figure 12:
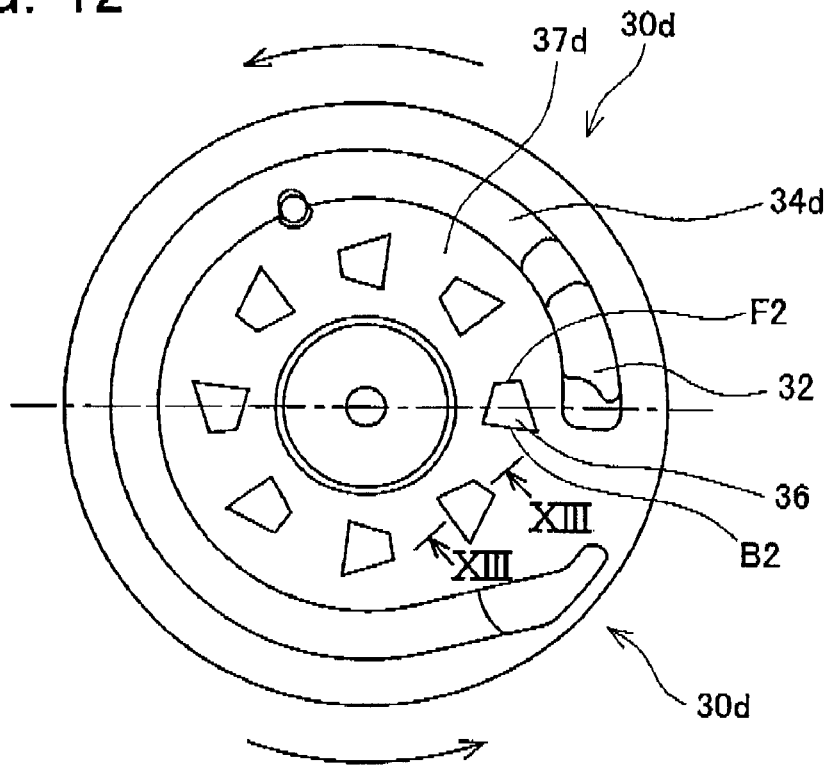
FIG. 12 schematically shows a plan view of the lower casing that is a cross-sectional view taken along the XII-XII line in FIG. 10.

As shown in FIG. 11, in a second surface 27*d* of the upper casing 20*d*, a second boost groove 22*d* is formed facing a plurality of boost ports 12 in a upper surface 17*d* of the impeller 10*d*. As shown in FIG. 12, in a first surface 37*d* of the lower casing 30*d*, a first boost groove 34*d* is formed facing a plurality of boost ports 14 in a lower surface 19*d* of the impeller 10*d*. In a plan view, the second boost groove 22*d* and the first boost groove 34*d* are formed to have an almost C-like shape from the upstream end to the downstream end along the rotational direction of the impeller 10*d*. A second boost path 42*d* is formed by a plurality of boost ports 12 provided in the upper surface 17*d* of the impeller 10*d* and the second boost groove 22*d* formed in the upper casing 20*d*, and a first boost path 44*d* is formed by a plurality of boost ports 14 provided in the lower surface 19*d* of the impeller 10*d* and the first boost groove 34*d* formed in the lower casing 30*d*. A fuel intake hole 32 (see also FIG. 12) is formed at the upstream end of the first boost groove 34*d* so as to be connected to the first boost groove 34*d*. A fuel discharge hole 24 (see also FIG. 11) is formed at the downstream end of the second boost groove 22*d* so as to be connected to the second boost groove 22*d*.

When the impeller 10*d* rotates between the upper casing 20*d* and the lower casing 30*d*, the fuel is sucked in from the fuel intake hole 32 into the pump unit and introduced into the first boost path 44*d* and the second boost path 42*d*. The fuel whose pressure increases while it flows in the first boost path 44*d* and the second boost path 42*d* is pumped out from the fuel discharge hole 24 into the motor unit. The fuel that is pumped out into the motor unit passes through the motor unit and is pumped out to the outside from a port (not shown in the figure) formed in the upper part of the fuel pump 1*d*.

FIG. 11 schematically shows a cross-sectional view along the XI-XI line of the pump unit shown in FIG. 10, wherein the upper casing 20*d* as shown in FIG. 10 is viewed from below. In the fuel pump 1*d*, eight depressions 26 are formed in a region on the inside of the second boost groove 22*d* of the upper casing 20*d*. The depressions 26 are formed repeatedly and equidistantly in the circumferential direction in the second surface 27*d* of the upper casing 20*d*. The depressions 26 are formed to have an almost trapezoidal shape in the plan view thereof. The depressions 26 are formed such that the width of the front edge F2 of the depression 26 in the impeller rotational direction (direction shown by an arrow in FIG. 11) is less than the width of the rear edge B2.

FIG. 12 schematically shows a cross-sectional view along the XII-XII line of the pump unit shown in FIG. 10, wherein the lower casing 30*d* as shown in FIG. 10 is viewed from above. In the fuel pump 1*d*, eight depressions 36 are formed in a region on the inside of the first boost groove 34*d* of the lower casing 30*d*. The depressions 36 are formed repeatedly and equidistantly in the circumferential direction in the first surface 37*d* of the lower casing 30*d*. The depressions 36 are formed to have an almost trapezoidal shape in the plan view thereof. The depressions 36 are formed such that the width of the front edge F2 of the depression 36 in the impeller rotational direction (direction shown by an arrow in FIG. 12) is less than the width of the rear edge B2.

Figure 13:
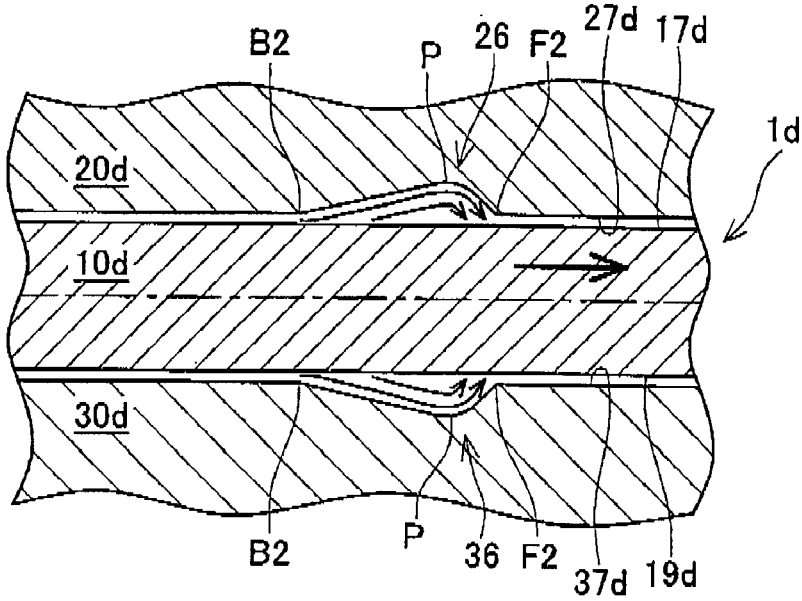
FIG. 13 schematically shows a cross-sectional view of the upper casing, lower casing, and impeller that is a cross-sectional view taken along the XIII-XIII line in FIGS. 11, 12.
Figure 14:
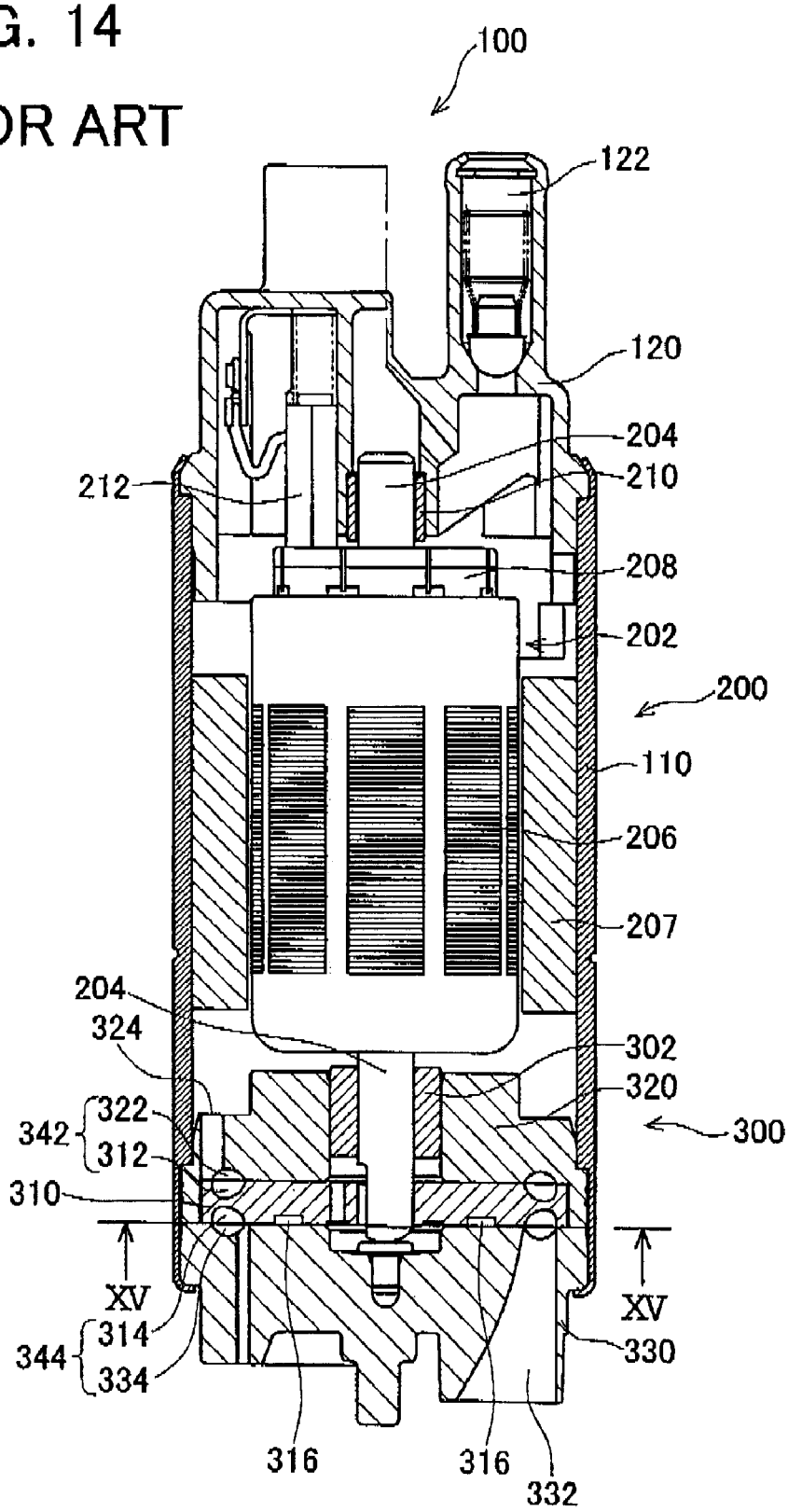
FIG. 14 PRIOR ART
FIG. 14 schematically shows a cross-sectional view of the conventional fuel pump.
Figure 15:
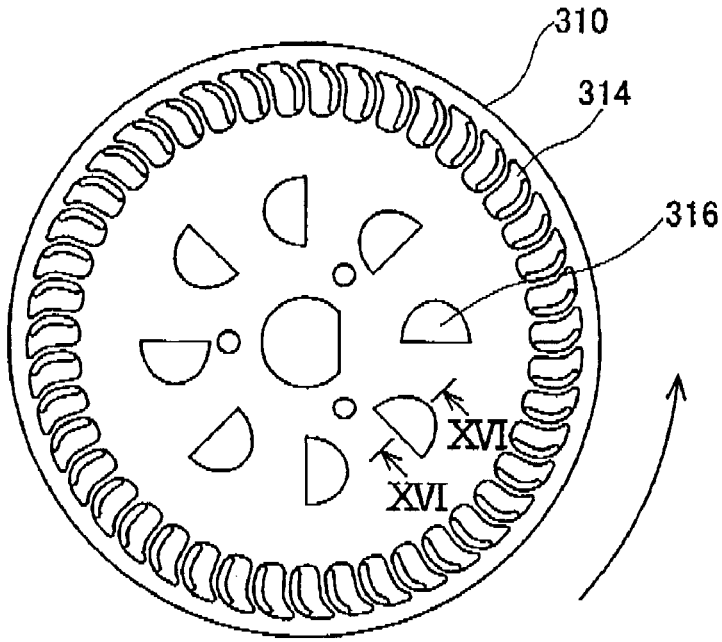
FIG. 15 PRIOR ART
FIG. 15 schematically shows a plan view of the conventional impeller.
Figure 16:
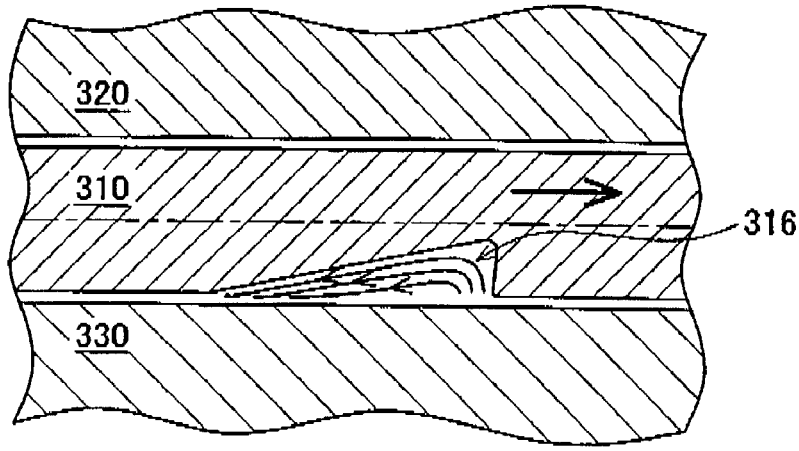
FIG. 16 PRIOR ART
FIG. 16 schematically shows a cross-sectional view of the depression provided in the conventional impeller.

FIG. 13 shows a cross-sectional view along the XIII-XIII line of the depressions 26, 36 shown in FIG. 11 and FIG. 12. The deepest portions P of the depressions 26, 36 are formed on the front side in the impeller rotational direction. The depressions 26, 36 are formed such that the cross-sectional area thereof decreases from the deepest portion P toward the front edge F2.

When the impeller 10*d* rotates, in a region between the upper surface 17*d* of the impeller 10*d* and the upper casing 20*d* where the second boost path 42*d* is not formed, and in a region between the lower surface 19*d* of the impeller 10*d* and the lower casing 30*d* where the first boost path 44*d* is not formed, the fuel is carried along by the impeller 10*d* rotating at a high rate and the fuel itself rotates, due to its viscosity, with a certain rate in the impeller rotational direction. Because the upper casing 20*d* and the lower casing 30*d* are fixed, part of the fuel located between the upper surface 17*d* of the impeller 10*d* and the upper casing 20*d* is introduced into the depression 26 formed in the inner surface 27*d* of the upper casing 20*d*, as shown in FIG. 13. The fuel introduced into the depression 26 flows in the same direction as the impeller rotational direction along the bottom wall surface of the depression 26. In the depression 26, the deepest portion P is formed in the front half thereof with respect to the rotational direction of the impeller 10*d*, and the fuel introduced into the depression 26 flows from the deepest portion P of the depression 26 toward the upper surface 17*d* of the impeller. As a result, pressure is generated in the direction of separating the impeller 10*d* from the upper casing 20*d*.

Further, part of the fuel located between the lower surface 19*d* of the impeller 10*d* and the lower casing 30*d* is introduced into the depression 36 formed in the inner surface 37*d* of the lower casing 30*d*, as shown in FIG. 13. The fuel introduced into the depression 36 flows in the same direction as the impeller rotational direction along the bottom wall surface of the depression 36. In the depression 36, the deepest portion P is formed in the front half thereof with respect to the rotational direction of the impeller 10*d*, and the fuel introduced into the depression 36 flows from the deepest portion P of the depression 36 toward the lower surface 19*d* of the impeller 10*d*. As a result, pressure is generated in the direction of separating the impeller 10*d* from the lower casing 30*d*.

The height of the impeller 10*d* is adjusted to the height where the two pressures are balanced, and the impeller 10*d* is rotated in a state of being separated from the upper casing 20*d* and the lower casing 30*d*. As a result, the impeller 10*d* is prevented from rotating in a state of being pressed against the upper casing 20*d* or the lower casing 30*d*, and frictional force acting upon the impeller 10*d* when the impeller rotates is reduced.

In the depressions 26, 36, a region from the deepest portion P toward the front edge F2 in the impeller rotational direction is a region where the aforementioned pressure is generated. In the depressions 26, 36 of the fuel pump 1*d* of the present embodiment, the figure of this region is requested to initiate only a flow of fuel from the deepest portion P toward the surfaces of the impeller 10*d*, so that this region is not required to be formed with any especially high dimensional accuracy and an allowable margin of error becomes large. Accordingly, a cost of forming the depressions 26, 28 can be reduced. As a result, the production cost of the fuel pump 1*d* can be reduced.

In the depressions 26, 36, the width of the rear edge B2 in the impeller rotational direction widens, thereby facilitating the introduction of fuel into the depressions 26, 36. Further, the width of the front edge F2 narrows and the cross-sectional area thereof decreases from the deepest portion P toward the front edge F2. Therefore, the fuel introduced into the depressions 26, 36 is pushed into the narrowing channel and flows under a comparatively strong force from the deepest portion P toward the impeller 10*d*. As a result, a comparatively large pressure can be generated in the direction of separating the impeller 10*d* from the casings.

Further, the depressions 26, 36 are formed on the inside of boost grooves 22*d*, 34*d*, these grooves being formed to have an almost C-like shape close to outer periphery. The region on the inside of the boost grooves 22*d*, 34*d* is wider than the region on the outside of the boost grooves 22*d*, 34*d*. Therefore, the depressions 26, 36 can be easily formed.

Further, pluralities of depressions 26, 36 are formed equidistantly in the circumferential direction in each casing. The pressures generated by the depressions 26 are added up to obtain a resultant pressure corresponding to the number of depressions 26 (eight in the present embodiment). The pressures generated by the depressions 36 are added up to obtain a resultant pressure corresponding to the number of depressions 36 (eight in the present embodiment). Therefore, a comparatively large pressure is generated in the direction of separating the impeller 10*d* from the upper casing 20*d* and the lower casing 30*d*.

In the present embodiment, a case is explained in which the depressions 26 are formed in the second surface 27*d* of the upper casing 20*d*, and the depressions 36 are formed in the first surface 37*d* of the lower casing 30*d*, but it is also possible to form only the depressions 36 in the first surface 37*d* of the lower casing 30*d*.

Further, in the embodiment described hereinabove, the depressions 26, 36 have a trapezoidal shape in a planar view thereof, but this shape of depressions 26, 36 is not limited, and the depressions may have any shape, provided that the width of the front edge F2 in the impeller rotational direction is less than the width of the rear edge B2. For example, the front edge F2 in the impeller rotational direction in a planar view thereof may have an arched shape, and the rear edge B2 may be formed to have a linear shape.

Further, in the above-described embodiments, fuel pumps were explained in which depressions were formed either in the impeller or in the casings, but the depressions may also be formed both in the impeller and in the casings.

Specific examples of the present invention are described above in detail, but these examples are merely illustrative and place no limitation on the scope of the patent claims. The technology described in the patent claims also encompasses various changes and modifications to the specific examples described above.

Furthermore, the technical elements explained in the present specification and drawings provide technical value and utility either independently or through various combinations. The present invention is not limited to the combinations described at the time the claims are filed. In addition, the purpose of the examples illustrated by the present specification and drawings is to satisfy multiple objectives simultaneously, and satisfying any one of those objectives gives technical value and utility to the present invention.

What is claimed is:

1. A fuel pump comprising a casing and an impeller, wherein:

the impeller is substantially disk shaped having an upper surface and a lower surface, and rotates in only one direction within the casing around a rotational axis;

a group of concavities is formed in each of the upper and lower surfaces of the impeller, and is arranged on a circle around the rotational axis of the impeller;

a first groove is formed in an inner surface of the casing, faces the group of concavities formed in the lower surface of the impeller, and extends from an upstream end to a downstream end along a rotational direction of the impeller;

a second groove is formed in the inner surface of the casing, faces the group of concavities formed in the upper surface of the impeller, and extends from an upstream end to a downstream end along the rotational direction of the impeller;

a fuel intake hole is formed in the casing and passes through the casing from the exterior of the casing to the upstream end of the first groove;

a fuel discharge hole is formed in the casing and passes through the casing from the downstream end of the second groove to the exterior of the casing;

a plurality of impeller depressions is formed in at least the lower surface of the impeller, located on at least one of the inside and the outside of the group of concavities, and arranged on a circle around the rotational axis of the impeller;

in a cross-section along a circumferential direction of the impeller, each of the impeller depressions has its deepest portion in a rear half thereof with respect to the rotational direction of the impeller; and the impeller has no depression having its deepest portion in a front half thereof with respect to the rotational direction of the impeller.

2. The fuel pump according to claim 1, wherein a width of the rear edge of each of the impeller depressions is narrower than a width of the front edge of each of the impeller depressions.

3. The fuel pump according to claim 1, wherein the plurality of impeller depressions is located on the inside of the group of concavities.

4. The fuel pump according to claim 1, wherein a plurality of through holes passing through the impeller from the upper surface to the lower surface is formed in the impeller; and each of the through holes is connected with the front edge of each of the impeller depressions.

5. The fuel pump according to claim 1, wherein a plurality of casing depressions is formed in at least the inner surface of the casing that faces the lower surface of the impeller, located on at least one of the inside and the outside of the group of concavities formed in the lower surface of the impeller, and arranged on a circle around the rotational axis of the impeller; and each of the casing depressions has its deepest portion in the front half thereof with respect to the rotational direction of the impeller.

6. The fuel pump according to claim 5, wherein a width of the front edge of each of the casing depressions is narrower than a width of the rear edge of each of the casing depressions.

7. The fuel pump according to claim 1, wherein each of the impeller depressions is formed along the circumferential direction of the impeller.

8. The fuel pump according to claim 1, wherein, for each of the impeller depressions, an edge at a front side of the impeller depression is formed as a straight line, and an edge at a rear side of the impeller depression is formed as a straight line; and wherein a width of the impeller depressions decreases from the edge at the front side of the impeller depression to the edge at the rear side of the impeller depression.

* * * * *